US008007319B2

(12) United States Patent
Dang

(10) Patent No.: US 8,007,319 B2
(45) Date of Patent: Aug. 30, 2011

(54) ELECTRICAL CONNECTOR CONTACTS RETAINED BY RELEASABLE FIRST AND SECOND INSERTS HELD BY RELEASABLE FIRST AND SECOND SHELLS

(75) Inventor: Phong Dang, Kent, WA (US)

(73) Assignee: Carlisle Interconnect Technologies, Inc., Tukwila, WA (US)

( * ) Notice: Subject to any disclaimer, the term of this patent is extended or adjusted under 35 U.S.C. 154(b) by 0 days.

(21) Appl. No.: 12/961,964

(22) Filed: Dec. 7, 2010

(65) Prior Publication Data

US 2011/0136369 A1 Jun. 9, 2011

Related U.S. Application Data

(60) Provisional application No. 61/267,339, filed on Dec. 7, 2009.

(51) Int. Cl.
*H01R 9/03* (2006.01)

(52) U.S. Cl. ..... 439/607.56

(58) Field of Classification Search ..... 439/607.45, 439/607.55, 607.56, 465, 449, 352–355
See application file for complete search history.

(56) References Cited

U.S. PATENT DOCUMENTS

| | | | | |
|---|---|---|---|---|
| 3,243,756 | A * | 3/1966 | Ruete et al. | 439/89 |
| 3,404,364 | A * | 10/1968 | Paullus et al. | 439/458 |
| 5,743,765 | A * | 4/1998 | Andrews et al. | 439/607.1 |
| 6,827,590 | B2 | 12/2004 | Huss et al. | |
| 7,140,897 | B2 | 11/2006 | Axenböck et al. | |
| 7,267,578 | B2 * | 9/2007 | Wu | 439/607.58 |
| 7,300,313 | B1 | 11/2007 | Whiteman et al. | |
| 7,416,445 | B1 | 8/2008 | Brown | |
| 7,494,377 | B2 | 2/2009 | Yohn et al. | |
| 7,918,684 | B2 * | 4/2011 | Lu | 439/395 |
| 2003/0096511 | A1 | 5/2003 | Nguyen | |
| 2009/0117784 | A1 * | 5/2009 | Wu | 439/660 |
| 2009/0203257 | A1 | 8/2009 | Clyatt | |
| 2011/0028024 | A1 * | 2/2011 | Lu | 439/395 |
| 2011/0028026 | A1 * | 2/2011 | Lu | 439/404 |
| 2011/0045709 | A1 * | 2/2011 | Xiong et al. | 439/701 |

* cited by examiner

*Primary Examiner* — Chandrika Prasad
(74) *Attorney, Agent, or Firm* — Stoel Rives LLP

(57) ABSTRACT

In accordance with one aspect, a connector includes contacts meeting MIL-C-39029/57 or MIL-C-39029/58 without requiring a retaining clip to hold such contacts in place and without embedding such contacts in a plastic housing. The contacts are attached to electrical power or data conductors and loaded into apertures in a rear and front insert. The rear and front insert are held together by a rear and front shell so the contacts remain secure in the apertures. In accordance with another aspect, a latching mechanism provides a robust, reliable mechanism for securing a socket portion of a connector to a plug portion of a connector.

24 Claims, 8 Drawing Sheets

ELECTRICAL CONNECTOR CONTACTS RETAINED BY RELEASABLE FIRST AND SECOND INSERTS HELD BY RELEASABLE FIRST AND SECOND SHELLS

RELATED APPLICATION

This application claims priority under 35 U.S.C. §119(e) to U.S. patent application Ser. No. 61/267,339, filed Dec. 7, 2009, for "Miniature Electrical Connector," which is fully incorporated by reference herein.

TECHNICAL FIELD

The present disclosure generally relates to connectors, and in particular to connectors for making electrical connections between power or data sources, receivers, or carriers.

BACKGROUND

The present inventor has recognized that typical electrical connectors using standard MIL-C-39029 contacts commonly use a retaining clip to hold them in the electrical connector. The present inventor has also recognized that retaining clips commonly require a removal tool to be used to remove such contacts from an electrical connector one at a time for repair or replacement. The present inventor has also recognized that retaining clips, which are commonly located with the contacts in the same bore of the connector body, increase the bore size needed to hold a contact and thus increase the required spacing, that is, the axis to axis distance, between such bore centers.

The present inventor has recognized that other common electrical connectors embed contacts in a plastic housing, which prevents wires from being crimped into such contacts. The present inventor has also recognized that soldering wires into such contacts consumes significant amounts of time and may cause the plastic housing to melt. Melting the plastic housing loosens the embedded contacts and results in an inferior electrical connector that may need to be rejected or re-worked.

SUMMARY

In accordance with one aspect, a connector includes contacts meeting U.S. military specification numbers MIL-C-39029/57 or MIL-C-39029/58 without requiring a retaining clip to hold such contacts in place and without embedding such contacts in a plastic housing. Alternatively, other suitable symmetric contacts as well as asymmetric contacts may be used. The contacts are attached to electrical power or data conductors and loaded into apertures in a rear insert and a front insert. The rear and front inserts are held together by a rear shell and a front shell so the contacts remain secure in the apertures. In accordance with another aspect, a latching mechanism provides a robust, reliable mechanism for securing a socket portion of a connector to a plug portion of a connector. In accordance with another aspect, the rear shell and front shell are releasably secured together to permit replacing the contacts without damaging the rear or front shells, i.e., the rear and front shells are re-useable after repairing or replacing contacts.

The disclosed embodiments overcome the above-identified disadvantages of existing connectors, or may address other disadvantages. Additional aspects and advantages will be apparent from the following detailed description of preferred embodiments, which proceeds with reference to the accompanying drawings.

DETAILED DESCRIPTION OF PREFERRED EMBODIMENTS

Although the following disclosure describes preferred embodiments, it should be understood that they can be implemented in many alternative forms, shapes, and sizes. Accordingly, the present invention is not limited by the following description.

Figure 1:
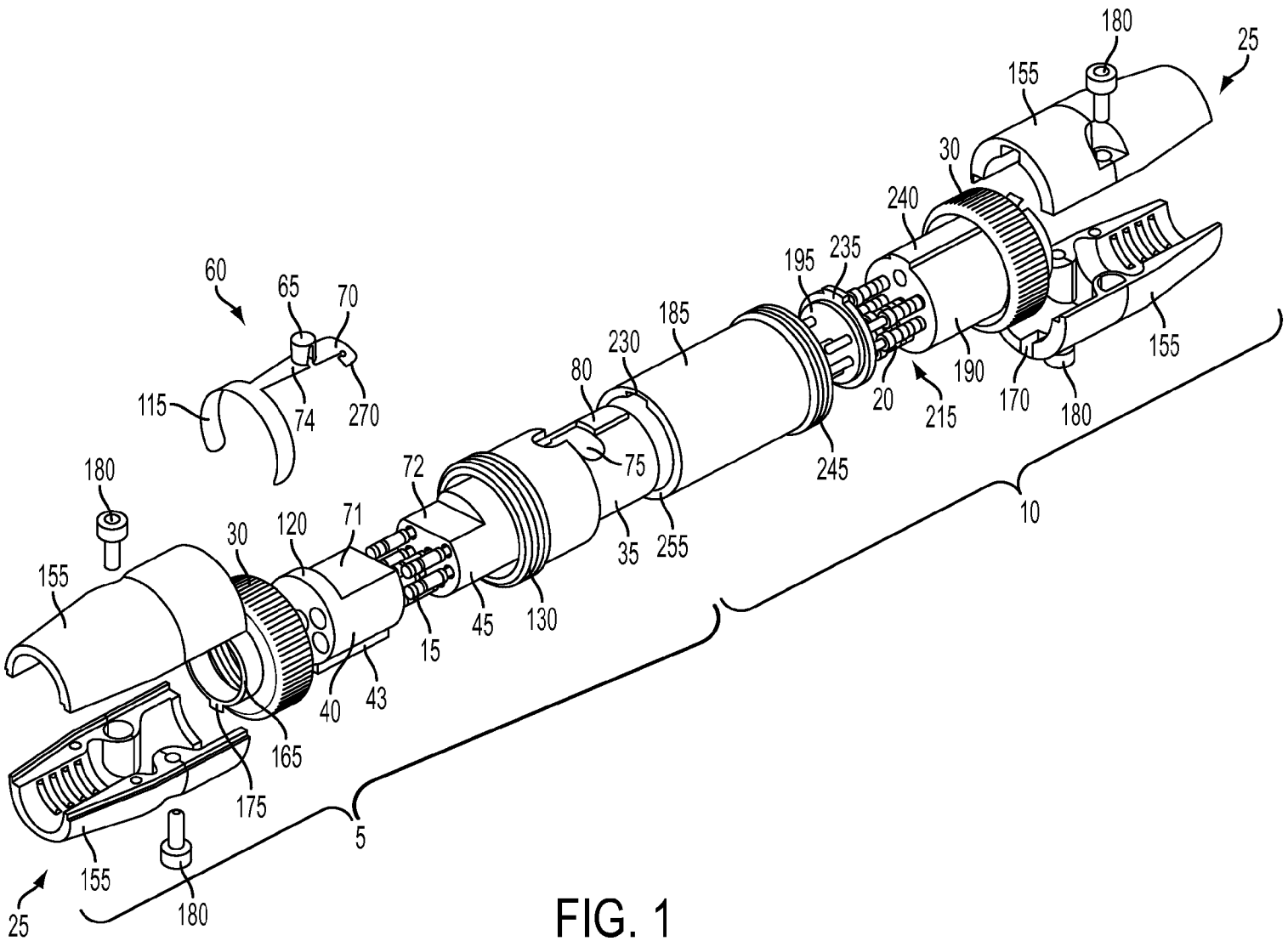
FIG. 1 is a partly exploded isometric assembly view of a socket and plug.
Figure 6:
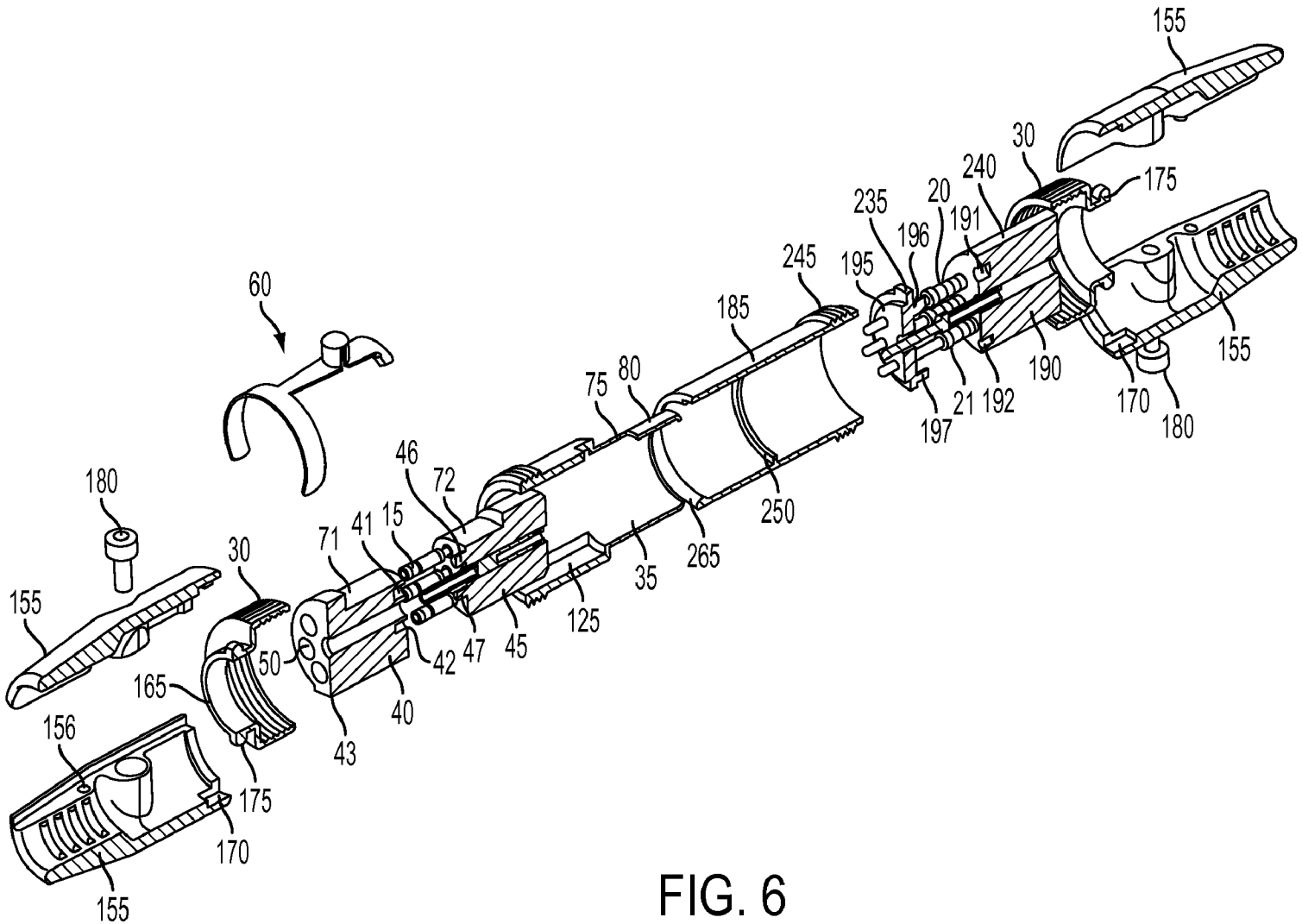
FIG. 6 is a partly exploded isometric, sectional assembly view of the socket and plug of FIG. 1.
Figure 7:
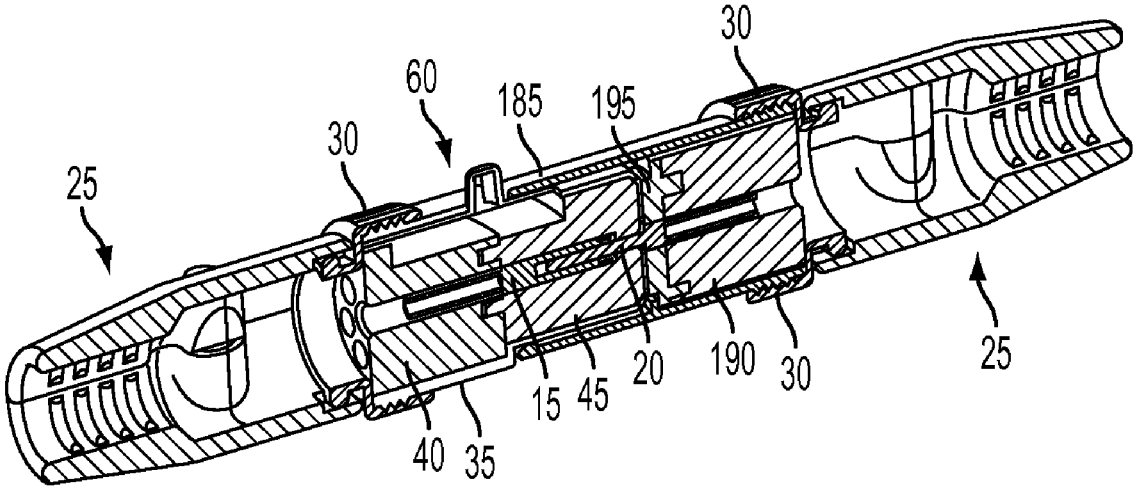
FIG. 7 is an isometric, sectional assembled view of the socket and plug of FIG. 1.

FIGS. 1, 6 and 7 illustrate mating socket and plug connectors 5 and 10. Socket connector 5 and plug connector 10 are illustrated with seven socket contacts 15 and seven plug contacts 20, each arranged with six contacts mutually angularly spaced apart, i.e., in a circle, and one contact mutually spaced apart from the other contacts and centrally located with respect to the other contacts. However, various numbers of socket contacts 15 and plug contacts 20 may be used, for example, 1, 2, 3, 4, 5, 6, 8, or more, and various contact arrangements may be used, such as mutually linearly spaced apart or other suitable arrangement. Socket contacts 15 and plug contacts 20 preferably meet the specification of MIL-C-39029/57 or MIL-C-39029/58 for contacts.

Socket

Referring to FIGS. 1-3, 6 and 7, socket connector 5 includes a strain relief, such as backshell 25, coupled to a rear shell 30, which is coupled to a front shell 35. Backshell 25, rear shell 30 and front shell 35 are preferably electrically conductive to provide grounding and electromagnetic interference ("EMI") protection for socket contacts 15 and conductors connected to socket contacts 15. Backshell 25 is preferably made from a composite material, such as a glass reinforced resin plated with a metal, such as nickel. Rear shell 30 and front shell 35 are preferably made from metal, such as nickel plated aluminum or other suitable conductor. Rear shell 30 and front shell 35 cooperate to releasably contain a rear insert 40 and a front insert 45, which in turn cooperate to releasably contain socket contacts 15 in contact apertures 50 and 55. Rear insert 40 and front insert 45 are preferably made from an electrically insulating material such as a glass filled polyetherimide or other suitable material.

Preferably, no retaining clip is needed to keep socket contacts 15 in contact apertures 50 and 55 when socket 5 is assembled. Not using a retaining clip preferably permits contact apertures 50 to be mutually spaced apart relatively close to one another. Likewise, contact apertures 55 are preferably mutually spaced apart relatively close to one another. Each contact aperture 50 includes a central axis 51, and each contact aperture 55 includes a central axis 56. Preferably, central axes 51 are mutually parallel and spaced-apart, that is, they are substantially parallel to one another to a degree sufficient to align with central axes 56 to hold an elongate contact 15 in a contact aperture 50 associated with a contact aperture 55. Likewise, central axes 56 are mutually parallel and spaced-apart, that is, they are substantially parallel to one another to a degree sufficient to align with central axes 51 to hold an elongate contact 15 in a contact aperture 55 associated with a contact aperture 50.

In a preferred arrangement sized for use with MIL-C-39029/57 or MIL-C-39029/58 contacts, the distance between adjacent central axes 51 is 0.100 inch (2.54 millimeter ("mm")) to 0.079 inch (2.0066 mm), and preferably 0.081 inch (2.0574 mm). Likewise, a preferred distance between adjacent central axes 56 is 0.100 inch (2.54 mm) to 0.079 inch (2.0066 mm), and preferably 0.081 inch (2.0574 mm). Alternatively, a distance between adjacent central axes may be approximately 0.090 inch (2.286 mm) to approximately 0.079 inch (2.0066 mm), or 0.083 inch (2.1082 mm) to 0.079 inch (2.0066 mm). The minimum distance between central axes, such as axes 51, may be influenced by geometric arrangement of the contact apertures, such as apertures 50, and the dielectric material used for rear insert 40 and front insert 45. Therefore, the minimum distance may be less than 0.079 inch (2.0066 mm). In an alternative arrangement, and independent of the size of the contacts used, contact apertures 50 or contact apertures 55 are preferably separated by a thickness of dielectric material that ranges from approximately 0.023 inch (0.5842 mm) to approximately 0.027 inch (0.6858 mm), and preferably approximately 0.025 inch (0.635 mm), at its thinnest point.

Figure 2:
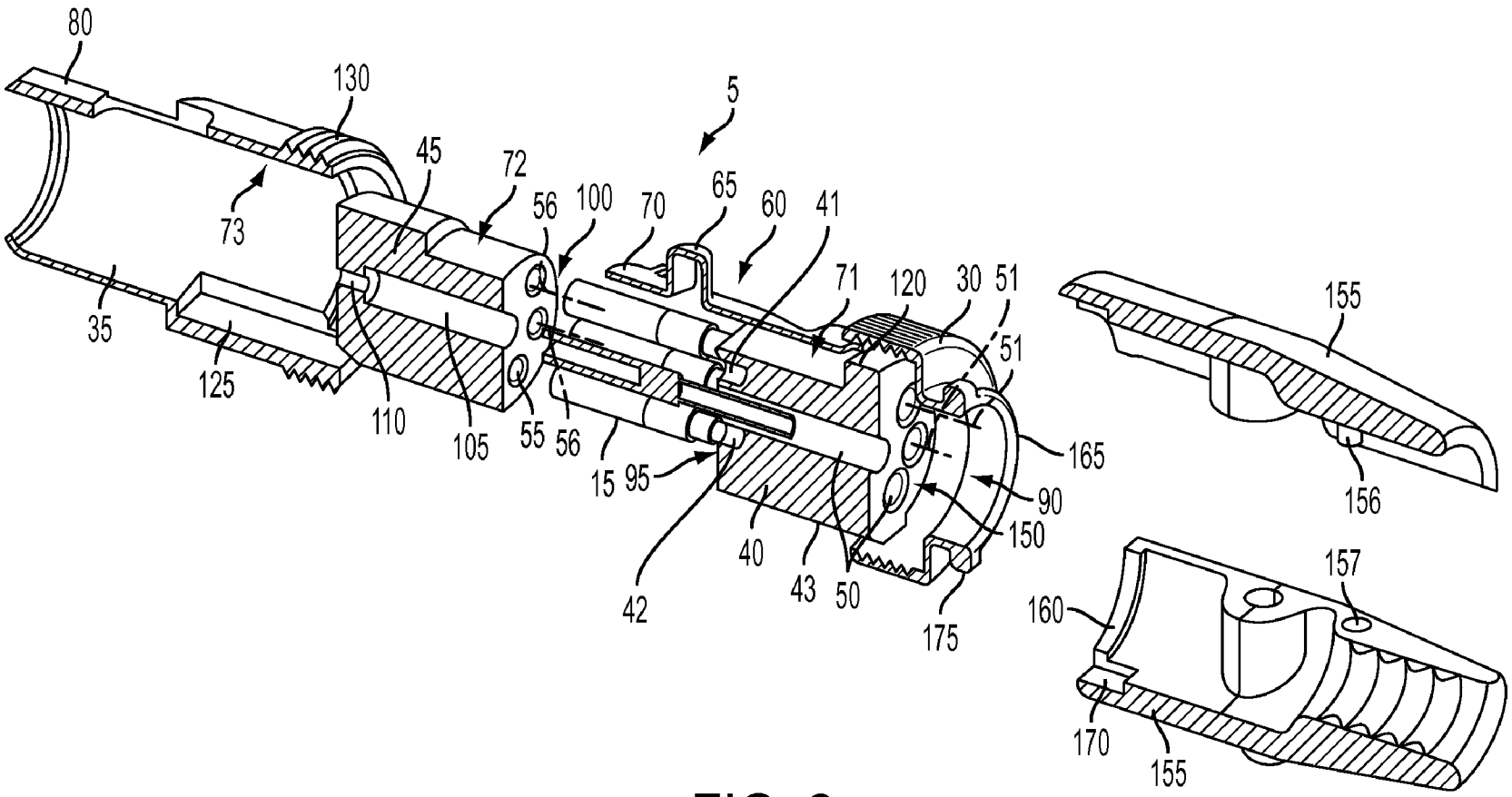
FIG. 2 is a partly exploded isometric, sectional assembly view of the socket of FIG. 1.
Figure 3:
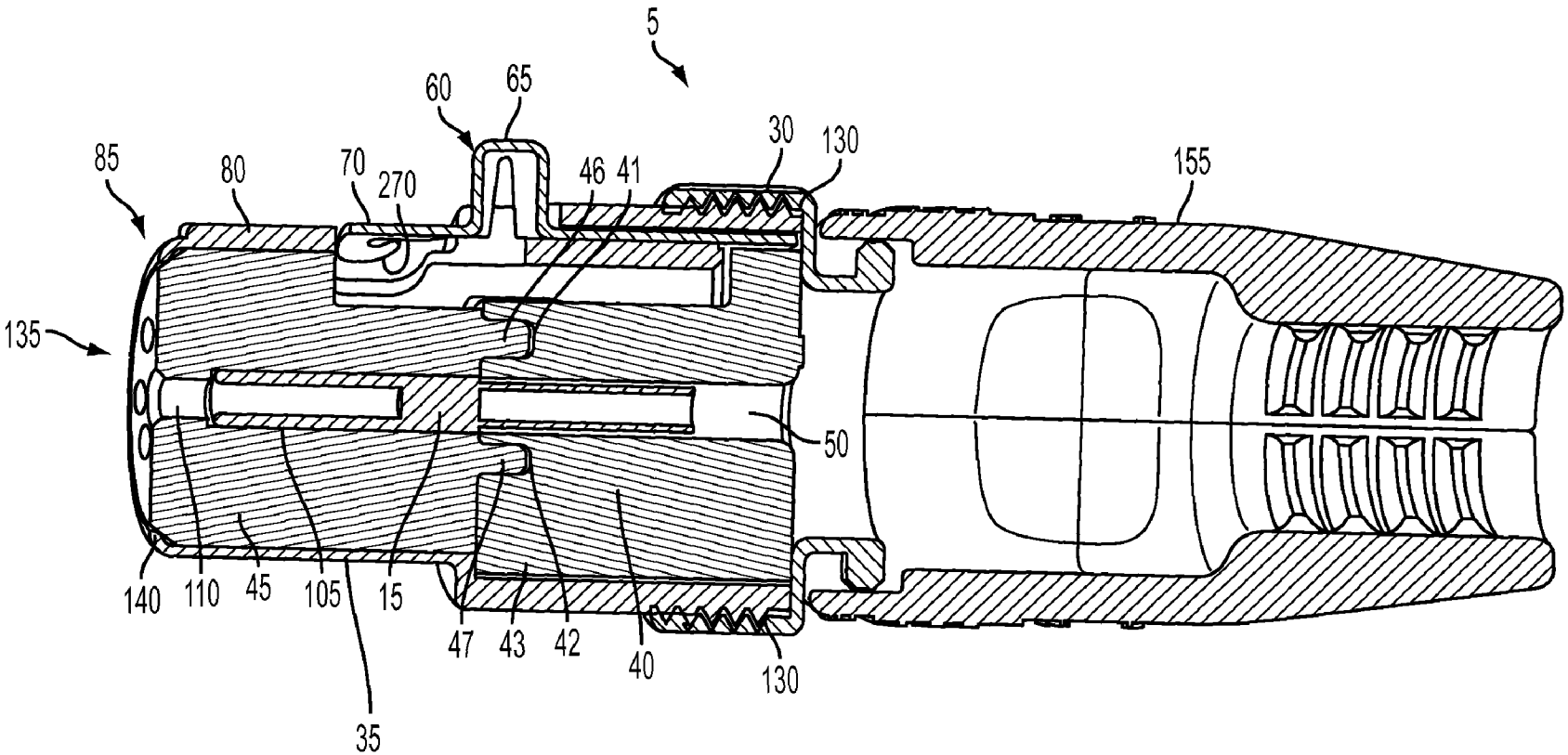
FIG. 3 is an enlarged sectional view of the assembled socket of FIG. 1.
Figure 4:
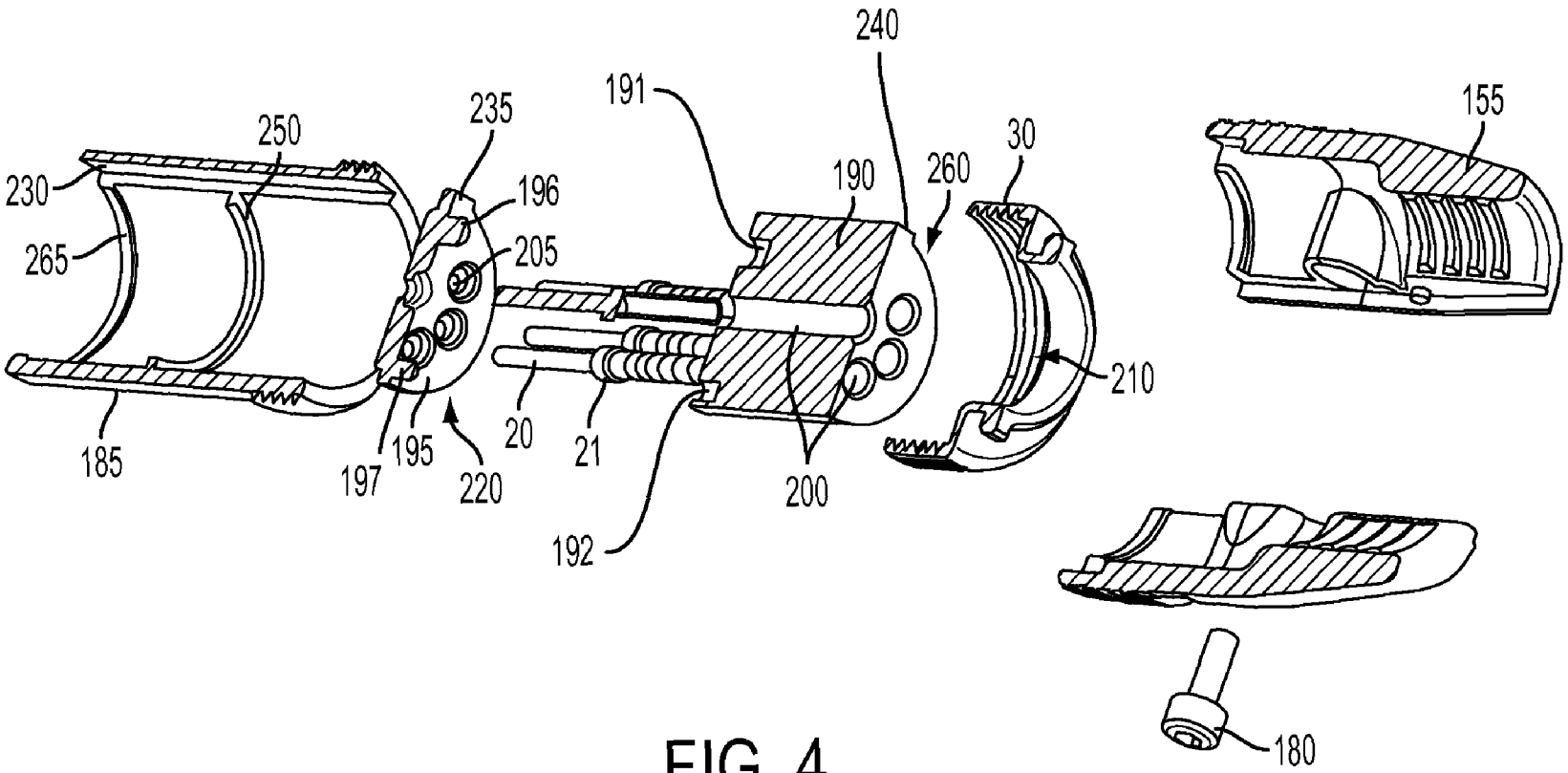
FIG. 4 is a partly exploded isometric, sectional assembly view of the plug of FIG. 1.

As best seen in FIGS. 2 and 3, a latch clip 60 engages rear insert 40 and is retained by rear shell 30 and front shell 35. Latch clip 60 includes a knob 65 and a "T" shaped latch 70. When socket 5 is assembled, knob 65 projects through a clip groove 75 (FIG. 1) formed through a wall of front shell 35. "T" shaped latch 70 is preferably suspended over clip recesses 71 and 72, which are formed in top surfaces of rear insert 40 and front insert 45, respectively. Operation of latch clip 60 to lock and unlock socket 5 and plug 10 from each other is described below.

Socket 5 is preferably assembled as follows. A cable or other suitable data or power conveying device (not illustrated) is threaded through an opening 90 in rear shell 30. The cable preferably includes one or more individual power or data carriers. Individual power or data carriers, such as insulated wires or wire bundles, internally reflective fiber optics, or other suitable carrier, are isolated and separated from one another. Each carrier is threaded through a contact aperture 50 through rear insert 40 and suitably prepared for insertion into socket contacts 15. A socket contact 15 is placed over and crimped onto each carrier, or otherwise suitably attached to each carrier.

Socket contacts 15 are loaded, or inserted, through contact apertures 50 from the front side 95 of rear insert 40, in other words, from the side facing or proximal to the plug connector 10 when the socket connector 5 and plug connector 10 are connected. Socket contacts 15 and plug sockets 20, described below, are preferably composed of cylindrical components, are preferably symmetric about a longitudinal axis, and are preferably characterized by a lengthwise nonuniform cross-sectional area, that is, the cross-section viewed along a length of a socket contact 15 displays at least two different cross-sectional areas. Alternatively, socket contacts may include non-cylindrical components and, may be asymmetric with respect to the longitudinal axis, or both. Contact apertures 50 are sized to permit socket contacts 15 to partly enter contact apertures 50 but not to pass completely through them. Preferably, contact apertures 50 are configured in complementary relation to the lengthwise nonuniform cross-sectional area of socket contacts 15 to prevent socket contacts 15 from passing completely through contact apertures 50. For example, contact apertures 50 may taper so they are larger at the front than at the back, contact apertures 50 may be stepped internally to create a shoulder that prevents socket contacts 15 from passing completely through, or contact apertures 50 may be sized to permit only a portion of socket contacts 15 to enter, for example, by making a large diameter portion or a shoulder on a socket contact 15 too large to enter contact apertures 50 (as illustrated in FIG. 3). Other suitable structures may be used for contact apertures 50 to prevent socket contacts 15 from completely passing through.

Socket contacts 15 are then inserted, or loaded, into contact apertures 55 in front insert 45 through the rear side 100 of front insert 45. Alternatively, socket contacts 15 may be entirely or substantially loaded into rear insert 40 and front insert 45 may act as a cap or stop that prevents socket contacts 15 from exiting contact apertures 50. Contact apertures 55 are also sized to permit socket contacts 15 to partly enter but not pass completely through contact apertures 55. Preferably, contact apertures 55 are configured in complementary relation to the lengthwise nonuniform cross-sectional area of socket contacts 15 to prevent socket contacts 15 from passing completely through contact apertures 55. As best illustrated in FIGS. 2 and 3, contact apertures 55 may include a large diameter portion 105 and a small diameter portion 110 where the large portion 105 is sized to accept socket contacts 15 and the small portion 110 is sized to accept plug contacts 20. As with contact apertures 50, other suitable structures may be used for contact apertures 55 to prevent socket contacts 15 from passing completely therethrough.

Preferably, rear insert 40 and front insert 45 include one or more alignment features to operatively couple the rear insert 40 with the front insert 45 and to prevent relative rotation from occurring between rear insert 40 and front insert 45, thus keeping contact apertures 50 and 55 aligned. Alignment features may include keys and keyways, pins and sockets, tongues and grooves, a unique array, such as a rotationally non-symmetric array, of contact apertures 50 and 55, or other suitable structures for aligning two components. For example, when rear insert 40 and front insert 45 are brought together, alignment knobs 46 and 47 projecting from the rear 100 of front insert 45 preferably fit into divots 41 and 42 formed in the front 95 of rear insert 40. Preferably knobs 46 and 47 are of different sizes, and divots 41 and 42 are correspondingly of different sizes so that only one angular orientation of rear insert 40 with respect to front insert 45 results in knobs 46 and 47 fitting into divots 41 and 42. Other alignment mechanisms may be used, such as knobs of the same size but differentially spaced and having corresponding divots, alignment grooves and projections, or other suitable mechanisms. When knobs 46 and 47 are fitted into divots 41 and 42, alignment projection 43 on rear insert 40 is properly aligned with front insert 45 for insertion into front shell 35. One of ordinary skill in the art will understand that the locations of portions of alignment features, such as a projection and a groove, may be swapped between one component and another.

Latch clip 60 engages rear insert 40. Preferably, latch clip 60 includes a "C" shaped clip portion 115 (FIG. 1) that engages, or snap fits onto, a flange 120 on rear insert 40. The elongate base portion 74 of "T" shaped latch 70 overlies recesses 71 and 72 formed in top surfaces of rear insert 40 and front insert 45, respectively. Preferably, elongate base portion 74 of "T" shaped latch 70 forms a cantilever beam with sufficient movement to permit knob 65 to pass into front shell 35 and to permit "T" shaped latch 70 to engage and disengage plug 10, as described below.

The assembled rear insert 40, front insert 45, socket contacts 15, and latch clip 60 are inserted into front shell 35. Alignment projection 43 of rear insert 40 slides into alignment groove 125 of front shell 35. Thus contact apertures 50 and 55, and therefore socket contacts 15, are preferably placed in a known, repeatable position with respect to front shell 35.

Figure 8:
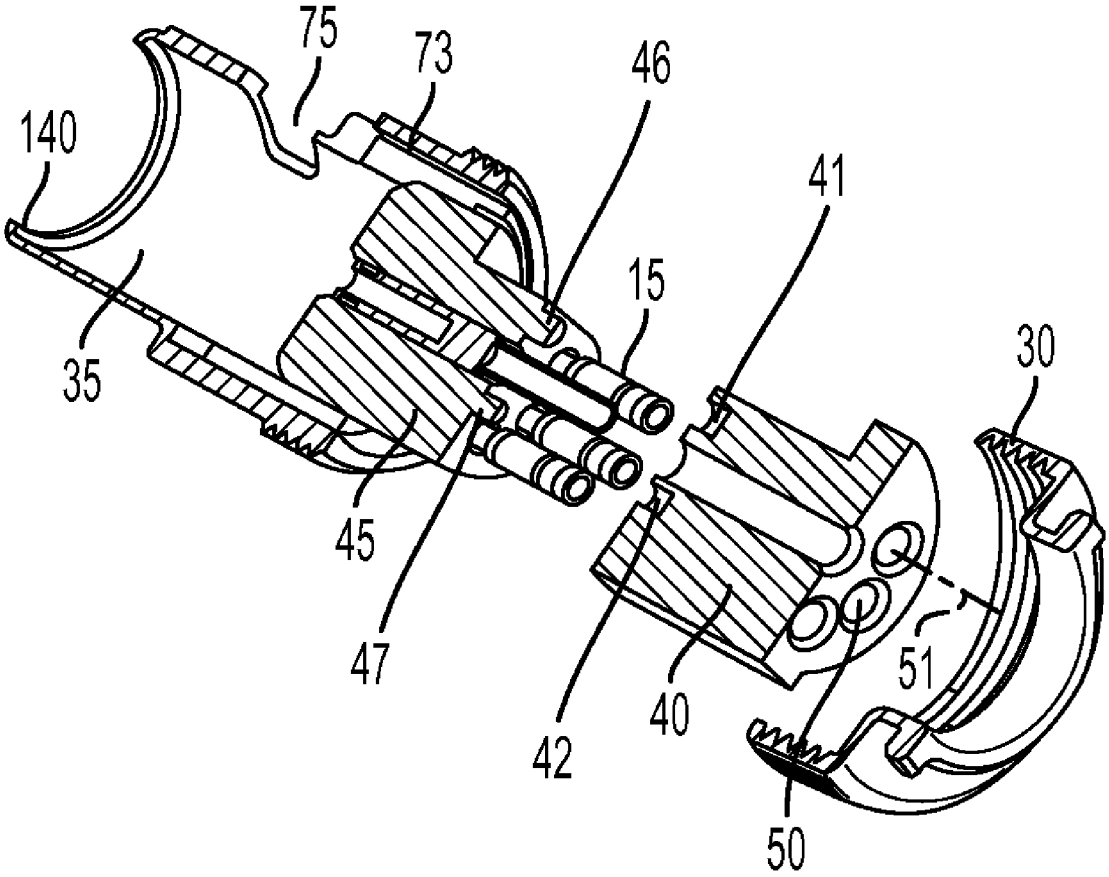
FIG. 8 is a partly exploded isometric, rear sectional assembly view of the socket of FIG. 1.

Latch 70 slides into clip alignment groove 73 (FIG. 8) in front shell 35, and knob 65 projects through clip groove 75. The combination of latch 70 engaging groove 73 and the proximity of knob 65 to the sidewalls of clip groove 75 prevents, or substantially prevents, latch clip 60 from rotating about a longitudinal axis of socket 5. Preventing rotational movement facilitates reliable operation of latch clip 60 and contributes to preventing wear occurrence of latch clip 60, front shell 35, and rear insert 40. The "T" shaped latch 70 projects through the end of clip groove 75 for engaging plug 10 as described below.

Rear shell 30 engages exterior threads 130 on front shell 35 and is releasably secured to front shell 35 to hold rear insert 40 and front insert 45 in contact, or substantially in contact, with each other. Other suitable releasable connections may be used that do not cause damage or inelastic (plastic) deformation to rear shell 30 or to front shell 35 when they are separated or joined. Preferably, the front end 135 of front insert 45 engages a lip 140 formed proximate the front end 85 of front shell 35 to prevent longitudinal movement of front insert 45 toward or past the front end 85 of front shell 35. Longitudinal movement of rear insert 40 towards rear shell 30 is mitigated or prevented by contact between rear shell 30 and the rear end 150 of rear insert 40. In other words, lip 140 and rear shell 30 preferably cooperate to retain rear insert 40 and front insert 45 and may clamp them together. In a preferred arrangement, when rear shell 30 is secured to front shell 35, a compressive force is imparted to rear insert 40 and front insert 45, but none of rear shell 30, front shell 35, rear insert 40, and front insert 45 are permanently deformed or damaged.

Socket contacts 15 are preferably prevented from longitudinal movement relative to one or more of front shell 35, rear insert 40, and front insert 45, or from substantial enough longitudinal movement to become disconnected from the power or data carriers (not illustrated). Such longitudinal movement restriction is a consequence of the inability of socket contacts 15 to pass through contact apertures 50 and 55 and the inability of rear insert 40 and front insert 45 to move longitudinally, or substantially longitudinally relative to one or more of front shell 35, rear insert 40, and front insert 45.

Backshell 25 is secured to rear shell 30 in a manner that compresses an electrical power or data conductor without imparting a twisting force to the electrical power or data conductor. For example, two backshell portions 155 may be located so a lip 160 (FIG. 2) engages a rim 165 on rear shell 30. Preferably, alignment grooves 170 in backshell portions 155 are engaged with alignment projections 175 on rim 165 to locate the backshell 25 with respect to the rear shell 30 and to prevent backshell 25 from rotating once installed on rear shell 30. Backshell portions 155 are preferably identical, or substantially identical, to each other and preferably include an alignment knob 156 and a corresponding alignment aperture 157. Preferably, a radius is applied to the rim of alignment knob 156 to facilitate insertion into aperture 157. Likewise, a radius is preferably applied to the rim of aperture 157 to facilitate receiving alignment knob 156. Backshell portions 155 are held together, for example, by screws 180 or other suitable fastener. One advantage from compressing an electrical power or data conductor without twisting the electrical power or data conductor is that no, or minimal, deformations are imparted to the electrical power or data conductor that could alter the performance characteristics of, or damage, the electrical power or data conductor.

Plug

Referring to FIGS. 1, and 4-7, plug connector 10 includes a strain relief, such as backshell 25 coupled to a rear shell 30, which is coupled to a front shell 185. Backshell 25, rear shell 30 and front shell 185 are preferably electrically conductive to provide grounding and EMI protection for plug contacts 20 and conductors connected to plug contacts 20 and are preferably made of materials as described above. Rear shell 30 and front shell 185 cooperate to releasably contain a rear insert 190 and a front insert 195, which in turn cooperate to releasably contain plug contacts 20 in contact apertures 200 and 205. Preferably, no retaining clip is needed to keep plug contacts 20 in contact apertures 200 and 205 when plug 10 is assembled, and contact apertures 200 and 205 may be mutually spaced apart relatively close to one another as described above with respect to contact apertures 50 and 55. Rear insert 190 and front insert 195 are preferably made from an electrically insulating material such as a glass filled polyetherimide or other suitable material.

Plug connector 10 is preferably assembled as follows. A cable or other suitable data or power conveying device (not illustrated) is threaded through an opening 210 in rear shell 30. The cable preferably includes one or more individual power or data carriers. Individual power or data carriers, such as insulated wires or wire bundles, internally reflective fiber optics, or other suitable carrier, are isolated and separated from one another. Each carrier is threaded through a contact aperture 200 through rear insert 190 and suitably prepared for insertion into plug contacts 20. A plug contact 20 is placed over and crimped onto each carrier, or otherwise suitably attached to each carrier.

Figure 5:
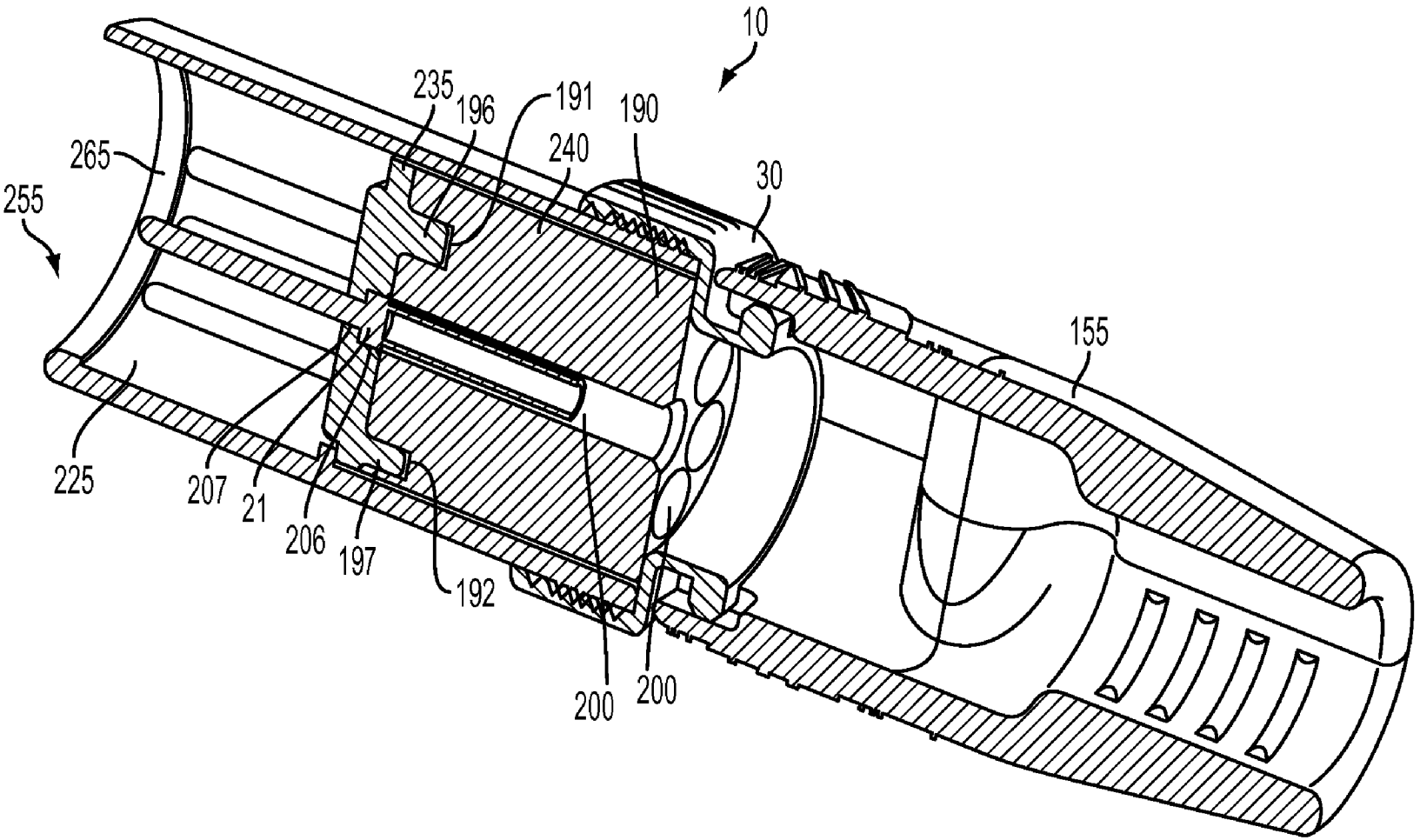
FIG. 5 is an enlarged isometric, sectional view of the assembled plug of FIG. 1.

Plug contacts 20 are loaded, or inserted, through contact apertures 200 from the front side 215 of rear insert 190, in other words, the side facing or proximal to the socket connector 5 when the socket connector 5 and plug connector 10 are connected. Contact apertures 200 are sized to permit plug contacts 20 to partly enter contact apertures 200 but not to pass completely through them. Preferably, contact apertures 200 are configured in complementary relation to the lengthwise nonuniform cross-sectional area of plug contacts 20 to prevent plug contacts 20 from passing completely through contact apertures 200. For example, contact apertures 200 may taper so they are larger at the front than at the back, contact apertures 200 may be stepped internally to create a shoulder that prevents plug contacts 20 from passing completely through, or contact apertures 200 may be sized to permit only a portion of plug contacts 20 to enter, for example, by making a large diameter portion or a shoulder on a plug contact 20 too large to enter contact apertures 200 (as illustrated in FIG. 5). Other suitable structures may be used for contact apertures 200 to prevent plug contacts 20 from completely passing through.

Plug contacts 20 are then inserted, or loaded, into contact apertures 205 in front insert 195 through the rear side 220 of front insert 195. Contact apertures 205 are sized to permit a portion of plug contacts 20 to pass through contact apertures 205, but to restrain the entirety of plug contacts 20 from passing completely through contact apertures 205. Preferably, contact apertures 205 are configured in complementary relation to the lengthwise nonuniform cross-sectional area of plug contacts 20 to prevent plug contacts 20 from passing completely through contact apertures 205. For example, contact apertures 205 preferably include a large diameter portion 206 and a small diameter portion 207. A shoulder 21 on plug contact 20 fits into large diameter portion 206, but cannot pass through small diameter portion 207 thus preventing plug contacts 20 from passing completely through contact apertures 205 without employing a retaining clip.

Preferably, rear insert 190 and front insert 195 include one or more alignment features to operatively couple the rear insert 190 with the front insert 195 and to prevent relative rotation from occurring between rear insert 190 and front insert 195, thus keeping contact apertures 200 and 205 aligned. For example, when rear insert 190 and front insert 195 are brought together, alignment knobs 196 and 197 projecting from the rear 220 of front insert 195 preferably fit into divots 191 and 192 formed in the front 215 of rear insert 190. Preferably knobs 196 and 197 are of different sizes, and divots 191 and 192 are correspondingly of different sizes so that only one angular orientation of rear insert 190 with respect to front insert 195 results in knobs 196 and 197 fitting into divots 191 and 192. Other alignment mechanisms may be used, such as knobs of the same size but differentially spaced and having corresponding divots, alignment grooves and projections, or other suitable mechanisms. When knobs 196 and 197 are fitted into divots 191 and 192, alignment projection 240 on rear insert 190 is preferably aligned with alignment projection 235 on front insert 195 for insertion into front shell 185.

The assembled rear insert 190, front insert 195, and plug contacts 20 are inserted into the inside 225 of front shell 185. The inside 225 of front shell 185 preferably has a constant, or relatively constant, diameter and is preferably dimensioned to create a press fit or an interference fit with rear insert 190 and front insert 195. Preferably, an alignment groove 230 is formed in the inside 225 of front shell 185. Alignment projections 235 and 240 on front insert 195 and rear insert 190, respectively, preferably align with each other and are inserted into alignment groove 230 when the assembled rear insert 190, front insert 195, and plug contacts 20 are inserted into the front shell 185. Thus contact apertures 200 and 205, and therefore plug contacts 20, are preferably placed in a known, repeatable position with respect to front shell 185.

Rear shell 30 engages exterior threads 245 on front shell 185 and is releasably secured to front shell 185 to hold rear insert 190 and front insert 195 in contact, or substantially in contact, with each other. Other suitable releasable connections may be used that do not cause damage or inelastic (plastic) deformation to rear shell 30 or to front shell 185 when they are separated or joined. Preferably, the press fit or interference fit between rear insert 190 and front insert 195 on the one hand and front shell 185 on the other holds front insert 195 in contact, or substantially in contact, with rear insert 190. Alternatively, front insert 195 may engage a lip 250 formed in the inside 225 of front shell 185 to prevent longitudinal movement of front insert 195 toward or past the front end 255 of front shell 185. Longitudinal movement of rear insert 190 towards rear shell 30 is prevented or mitigated by contact between rear shell 30 and the rear end 260 of rear insert 190. In other words, lip 250 and rear shell 30 preferably cooperate to retain rear insert 190 and front insert 195 and may clamp them together. In a preferred arrangement, when rear shell 30 is secured to front shell 185, a compressive force is imparted to rear insert 190 and front insert 195, but none of rear shell 30, front shell 185, rear insert 190, and front insert 195 are permanently deformed or damaged.

Plug contacts 20 are preferably prevented from longitudinal movement with respect to one or more of front shell 185, rear insert 190, and front insert 195, or from substantial enough longitudinal movement to become disconnected from the power or data carriers. Preferably, such longitudinal movement restriction is a consequence of the inability of plug contacts 20 to pass completely through contact apertures 200 and 205 and the inability of rear insert 190 and front insert 195 to move longitudinally, or substantially longitudinally with respect to one or more of front shell 185, rear insert 190, and front insert 195. In other embodiments, both a press or interference fit and engagement with a lip on the inside of a front shell, for example, as described above, may be used to hold front and rear inserts together.

Backshell 25 is secured to rear shell 30. For example, two backshell portions 155 may be located so a lip 160 engages a rim 165 on rear shell 30. Preferably, alignment grooves 170 in backshell portions 155 are engaged with alignment projections 175 on rim 165 to properly locate the backshell 25 with respect to the rear shell 30 and to prevent backshell 25 from rotating once installed on rear shell 30. Backshell portions 155 are preferably identical, or substantially identical, to each other and preferably include an alignment knob 156 and a corresponding alignment aperture 157. Preferably, a radius is applied to the rim of alignment knob 156 to facilitate insertion into aperture 157. Likewise, a radius is preferably applied to the rim of aperture 157 to facilitate receiving alignment knob 156. Backshell portions 155 are held together, for example, by screws 180 or other suitable fastener.

Assembling backshell 25 from two or more pieces facilitates locating a cable or other suitable data or power conveying device therethrough, and facilitates compressing a cable or other suitable data or power conveying device to provide electrical grounding, EMI signal protection, or both. Preferably, backshell portions 155 are made from a nickel plated composite material to facilitate electrical grounding, EMI protection, or both.

Joining Socket & Plug

When an assembled socket connector 5 is connected to an assembled plug connector 10, an alignment projection 80 on front shell 35 of socket 5 engages the alignment groove 230 formed in front shell 185 of plug 10. Engaging alignment projection 80 with alignment groove 230 aligns socket contacts 15 with plug contacts 20 so they may be securely connected without damage.

As socket connector 5 and plug connector 10 are further brought into engagement, front shell 185 of plug connector 10 slides over a reduced diameter portion of front shell 35 of socket connector 5 until locking lip 265 engages "T" shaped latch 70. "T" shaped latch 70 preferably includes angled wings 270 that cause the "T" shaped latch 70 to flex away from front shell 185 as locking lip 265 passes over angled wings 270. Once locking lip 265 passes angled wings 270, the "T" shaped latch 70 snaps towards front shell 185 to provide an audible click indicating that socket 5 and plug 10 are locked together. Angled wings 270 engage locking lip 265 to prevent socket 5 and plug 10 from disengaging each other.

Pressing on knob 65 causes "T" shaped latch 70 to flex away from front shell 185 into recesses 72 and 71 and disengage angled wings 270 from locking lip 265. With knob 65 depressed, socket connector 5 may be disengaged from plug connector 10.

Disassembly

Releasably securing backshells 25 to rear shells 30 and releasably securing rear shells 30 to front shells 35 and 185 permits facilitated access to socket contacts 15 and plug contacts 20 without damaging or deforming components used to form socket connector 5 and plug connector 10. By disassembling the threaded connections the rear shells 30 may be removed from front shells 35 and 185 thus permitting rear inserts 40 and 190 to be removed. Removing rear inserts 40 and 190 exposes socket contacts 15 and plug contacts 20, thus facilitating repairs or modifications needed for socket 5 or plug 10. In other words, replacing or repairing socket contacts 15 and plug contacts 20 is relatively easily accomplished by unthreading rear shells 30 from front shells 35 and 185 without using tools and without damaging or deforming socket connector 5 or plug connector 10. Releasably securing backshells 25 to rear shells 30 and releasably securing rear shells 30 to front shells 35 and 185 also preferably permits backshells 25, rear shells 30, and front shells 35 and 185 to be reused when repairing or replacing socket contacts 15 or plug contacts 20. In alternative embodiments, a thread locking material may be used between the threads of rear shells 30 and front shells 35 and 185, which may require pliers or other suitable tools to initially rotate the rear shells 30 with respect to the front shells 35 and 185.

Alternatively, rear shells 30 may be non-releasably secured to front shells 35 or 185 for a connection that does not provide facilitated access to the contacts 15 and 20, the rear inserts 40 and 190, or the front inserts 45 and 195.

It will be obvious to those having skill in the art that many changes may be made to the details of the above-described embodiments without departing from the underlying principles of the invention. The scope of the present invention should, therefore, be determined only by the following claims.

The invention claimed is:

1. A multi-component electrical connector, comprising:

a rear insert having an interior longitudinally bounded by front and rear surfaces, the rear insert including multiple first contact-receiving apertures through which mutually parallel, spaced-apart first central axes extend and which pass through the interior and the front and rear surfaces, the first contact-receiving apertures being sized to receive, by insertion from the front surface, first ends of elongate contacts characterized by a lengthwise nonuniform cross-sectional area and being configured in complementary relation to the nonuniform cross-sectional area to prevent the inserted elongate contacts from passing completely through the first contact-receiving apertures;

a front insert having an interior longitudinally bounded by front and rear surfaces and positioned relative to the rear insert so that the rear surface of the front insert and the front surface of the rear insert are adjacent to each other, the front insert including multiple second contact-receiving apertures through which mutually parallel, spaced-apart second central axes extend and which pass through the interior and the front and rear surfaces, the second contact-receiving apertures sized to receive, by insertion from the rear surface of the front insert, second ends of the elongate contacts and configured in complementary relation to the nonuniform cross-sectional area to prevent the inserted elongate contacts from passing completely through the second contact-receiving apertures, wherein the first and second central axes of corresponding ones of the first and second contact-receiving apertures are aligned to hold an associated one of the elongate contacts;

front and rear tubular shells releasably securable to each other to, when secured together, contain and prevent separation of the rear and front inserts; and shell alignment features operatively coupling at least one of the rear and front inserts with at least one of the front and rear tubular shells to establish alignment of the rear and front inserts with respect to the front and rear tubular shells.

2. A multi-component electrical connector according to claim 1, further comprising:

insert alignment features cooperating to establish alignment of the first and second central axes of corresponding ones of the first and second contact-receiving apertures so that they hold an associated one of the elongate contacts.

3. A multi-component electrical connector according to claim 1, further comprising:

a tubular backshell non-rotatably, releasably securable to the rear tubular shell, wherein the tubular backshell includes first and second portions releasably securable together.

4. A multi-component electrical connector according to claim 1, further comprising:

a recess formed in at least one of the rear insert and the front insert;

a clip groove formed through a wall of the front shell; and a latch clip engaging the rear insert and substantially overlying the recess to project a latch through the clip groove.

5. A multi-component electrical connector according to claim 4, wherein the latch includes a "T" shaped latch having two angled wings projecting through the clip groove and a knob projecting through the clip groove.

6. A multi-component electrical connector according to claim 4, further comprising:

a connector alignment feature sized and positioned to operatively couple the electrical connector with a second electrical connector bearing a mating connector alignment feature to establish alignment of the electrical connector with respect to the second electrical connector.

7. A multi-component electrical connector according to claim 6, further comprising a second electrical connector, wherein the second electrical connector includes:

a rear insert having an interior longitudinally bounded by front and rear surfaces, the rear insert including multiple first contact-receiving apertures through which mutually parallel, spaced-apart first central axes extend and which pass through the interior and the front and rear surfaces, the first contact-receiving apertures being sized to receive, by insertion from the front surface, first ends of elongate contacts characterized by a lengthwise nonuniform cross-sectional area and being configured in complementary relation to the nonuniform cross-sectional area to prevent the inserted elongate contacts from passing completely through the first contact-receiving apertures;

a front insert having an interior longitudinally bounded by front and rear surfaces and positioned relative to the rear insert so that the rear surface of the front insert and the front surface of the rear insert are adjacent to each other, the front insert including multiple second contact-receiving apertures through which mutually parallel, spaced-apart second central axes extend and which pass through the interior and the front and rear surfaces, the second contact-receiving apertures sized to receive, by insertion from the rear surface, second ends of the elongate contacts and configured in complementary relation to the nonuniform cross-sectional area to prevent the inserted elongate contacts from passing completely through the second contact-receiving apertures, wherein the first and second central axes of corresponding ones of the first and second contact-receiving apertures are aligned to hold an associated one of the elongate contacts;

front and rear tubular shells releasably securable to each other to, when secured together, contain and prevent separation of the rear and front inserts; and shell alignment features operatively coupling at least one of the rear and front inserts with at least one of the front and rear tubular shells to establish alignment of the rear and front inserts with respect to the front and rear tubular shells.

8. A multi-component electrical connector according to claim 1, wherein:

each of the first contact-receiving apertures includes a constant diameter along a longitudinal length; and each of the second contact-receiving apertures includes a longitudinal section having a first diameter and a longitudinal section having a second diameter, wherein the second diameter is less than the first diameter.

9. An electrical connector comprising:

a rear insert having (1) a rear surface, (2) a front surface, (3) a first portion of a first alignment feature, (4) a first portion of a second alignment feature located on an exterior wall between the front and rear surfaces, and (5) a first contact aperture extending between the rear surface and the front surface, wherein the first contact aperture is sized to receive a portion of a contact loaded into the first contact aperture from the front surface side and wherein the first contact aperture is sized to prevent the contact from passing completely through the first contact aperture;

a front insert having (1) a rear surface substantially contacting the front surface of the rear insert, (2) a front surface facing away from the rear insert, (3) a second contact aperture extending between the rear surface and the front surface, wherein the second contact aperture is sized to receive a portion of the contact loaded into the second contact aperture from the rear surface side and wherein the second contact aperture is sized to prevent the entire contact from passing completely through the second contact aperture, and (4) a second portion of the first alignment feature engaging the first portion of the first alignment feature to align the first contact aperture with the second contact aperture;

a front shell sized to receive the rear insert and the front insert, the front shell having (1) a lip engaging the front insert to prevent the front insert from passing through the front shell, and (2) a second portion of the second alignment feature engaging the first portion of the second alignment feature to place the first and second contact apertures in a known position with respect to the front shell; and a rear shell releasably secured to the front shell to hold the rear insert and the front insert together.

10. An electrical connector according to claim 9 further comprising:

a backshell releasably, non-rotatably secured to the rear shell.

11. An electrical connector according to claim 10 further comprising a rim located on the rear shell facing the backshell, and wherein:

the backshell includes a first backshell portion and a second backshell portion engaging the rim and a first fastener and a second fastener securing the first and second backshell portions together.

12. An electrical connector according to claim 11 further comprising:

a first portion of a third alignment feature located on the rim;

a second portion of the third alignment feature located on the rim;

a third portion of the third alignment feature located on the first backshell portion and fitting the first portion of the third alignment feature; and a fourth portion of the third alignment feature located on the second backshell portion and fitting the second portion of the third alignment feature; and wherein the first backshell portion is substantially identical to the second backshell portion.

13. An electrical connector according to claim 12 further comprising:

a first portion of a fourth alignment feature located on the first backshell portion; and a second portion of the fourth alignment feature located on the second backshell portion and fitting the first portion of the fourth alignment feature.

14. An electrical connector according to claim 9 further comprising:

a recess formed in at least one of the rear insert and the front insert;

a clip groove formed through a wall of the front shell; and a latch clip engaging the rear insert and substantially overlying the recess to project a latch through the clip groove.

15. An electrical connector according to claim 14 wherein the latch includes a "T" shaped latch having two angled wings projecting through the clip groove and a knob projecting through the clip groove.

16. An electrical connector according to claim 14 wherein the front shell includes a clip alignment groove, and wherein a portion of the latch clip is retained from rotating about a longitudinal axis of the electrical connector by the clip alignment groove.

17. An electrical connector according to claim 16 wherein:

a first portion of the recess is formed in the rear insert; and a second portion of the recess is formed in the front insert.

18. An electrical connector according to claim 9 wherein the rear shell is releasably secured to the front shell via a threaded engagement.

19. A method of assembling an electrical connector comprising:

passing a data or power conveying feature through an opening in a rear shell;

passing a power or data carrier through a first contact aperture in a rear insert;

crimping a contact onto the carrier;

loading the contact into the first contact aperture from a front side of the rear insert;

loading the contact into a second contact aperture in a front insert through a rear side of the front insert;

fitting a first portion of a first alignment feature located on the front side of the rear insert into a second portion of the first alignment feature located on the rear side of the front insert to form an insert assembly;

placing the insert assembly into a front shell;

engaging a first portion of a second alignment feature located on the rear insert with a second portion of the second alignment feature located on the front shell to place the contact in a known position with respect to the front shell; and releasably securing a rear shell to the front shell to hold the rear insert and the front insert substantially in contact with each other.

20. A method according to claim 19, further comprising:

non-rotatably engaging a first backshell portion to the rear shell;

non-rotatably engaging a second backshell portion to the rear shell; and securing the first and second backshell portions to each other.

21. A method according to claim 19, further comprising:

engaging a latch clip with the rear insert;

restraining the latch clip from rotating about a longitudinal axis of the electrical connector by engaging the latch clip with a clip alignment groove of the front shell; and projecting a latch through a clip groove of the front shell.

22. An electrical connector comprising:

a contact;

a releasable first and second insert means for retaining the contact; and a releasable first and second shell means for retaining the first and second insert means.

23. An electrical connector according to claim 22, further comprising a latch means for releasably connecting the electrical connector to another electrical connector.

24. An electrical connector according to claim 22, further comprising a backshell means for providing a strain relief.

* * * * *

UNITED STATES PATENT AND TRADEMARK OFFICE

CERTIFICATE OF CORRECTION

PATENT NO. : 8,007,319 B2
APPLICATION NO. : 12/961964
DATED : August 30, 2011
INVENTOR(S) : Phong Dang It is certified that error appears in the above-identified patent and that said Letters Patent is hereby corrected as shown below:

In Column 14, claims 22, 23 and 24, delete lines 2 through 12.

Signed and Sealed this
Twenty-ninth Day of November, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,007,319 B2
APPLICATION NO. : 12/961964
DATED : August 30, 2011
INVENTOR(S) : Phong Dang It is certified that error appears in the above-identified patent and that said Letters Patent is hereby corrected as shown below:

Delete the title page and substitute therefore the attached title page showing the corrected number of claims in patent.

Column 14, lines 2-12, delete claims 22-24.

This certificate supersedes the Certificate of Correction issued November 29, 2011.

Signed and Sealed this
Tenth Day of January, 2012

David J. Kappos

David J. Kappos
*Director of the United States Patent and Trademark Office*

(12) United States Patent
Dang

(10) Patent No.: US 8,007,319 B2
(45) Date of Patent: Aug. 30, 2011

(54) ELECTRICAL CONNECTOR CONTACTS RETAINED BY RELEASABLE FIRST AND SECOND INSERTS HELD BY RELEASABLE FIRST AND SECOND SHELLS

(75) Inventor: Phong Dang, Kent, WA (US)

(73) Assignee: Carlisle Interconnect Technologies, Inc., Tukwila, WA (US)

( * ) Notice: Subject to any disclaimer, the term of this patent is extended or adjusted under 35 U.S.C. 154(b) by 0 days.

(21) Appl. No.: 12/961,964

(22) Filed: Dec. 7, 2010

(65) Prior Publication Data

US 2011/0136369 A1 Jun. 9, 2011

Related U.S. Application Data

(60) Provisional application No. 61/267,339, filed on Dec. 7, 2009.

(51) Int. Cl.
*H01R 9/03* (2006.01)

(52) U.S. Cl. ..... 439/607.56

(58) Field of Classification Search ..... 439/607.45, 439/607.55, 607.56, 465, 449, 352-355
See application file for complete search history.

(56) References Cited

U.S. PATENT DOCUMENTS

| | | | | |
|---|---|---|---|---|
| 3,243,756 | A * | 3/1966 | Ruete et al. | 439/89 |
| 3,404,364 | A * | 10/1968 | Paullus et al. | 439/458 |
| 5,743,765 | A * | 4/1998 | Andrews et al. | 439/607.1 |
| 6,827,590 | B2 | 12/2004 | Huss et al. | |
| 7,140,897 | B2 | 11/2006 | Axenböck et al. | |
| 7,267,578 | B2 * | 9/2007 | Wu | 439/607.58 |
| 7,300,313 | B1 | 11/2007 | Whiteman et al. | |
| 7,416,445 | B1 | 8/2008 | Brown | |
| 7,494,377 | B2 | 2/2009 | Yohn et al. | |
| 7,918,684 | B2 * | 4/2011 | Lu | 439/395 |
| 2003/0096511 | A1 | 5/2003 | Nguyen | |
| 2009/0117784 | A1 * | 5/2009 | Wu | 439/660 |
| 2009/0203257 | A1 | 8/2009 | Clyatt | |
| 2011/0028024 | A1 * | 2/2011 | Lu | 439/395 |
| 2011/0028026 | A1 * | 2/2011 | Lu | 439/404 |
| 2011/0045709 | A1 * | 2/2011 | Xiong et al. | 439/701 |

* cited by examiner

*Primary Examiner* — Chandrika Prasad
(74) *Attorney, Agent, or Firm* — Stoel Rives LLP

(57) ABSTRACT

In accordance with one aspect, a connector includes contacts meeting MIL-C-39029/57 or MIL-C-39029/58 without requiring a retaining clip to hold such contacts in place and without embedding such contacts in a plastic housing. The contacts are attached to electrical power or data conductors and loaded into apertures in a rear and front insert. The rear and front insert are held together by a rear and front shell so the contacts remain secure in the apertures. In accordance with another aspect, a latching mechanism provides a robust, reliable mechanism for securing a socket portion of a connector to a plug portion of a connector.

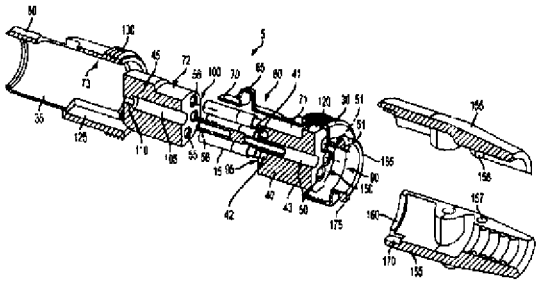

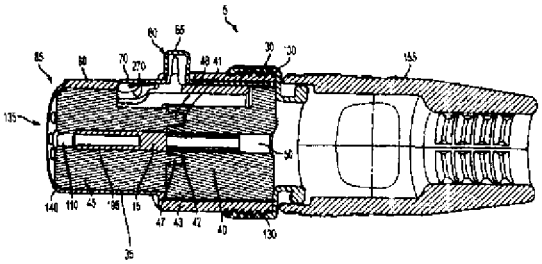

21 Claims, 8 Drawing Sheets